United States Patent [19]

Oltman et al.

[11] 4,197,954

[45] Apr. 15, 1980

[54] CONTAINER

[75] Inventors: Eugene W. Oltman, Gladstone; Robert N. Hills, Raytown, both of Mo.

[73] Assignee: Ethyl Development Corporation, Baton Rouge, La.

[21] Appl. No.: 948,772

[22] Filed: Oct. 5, 1978

[51] Int. Cl.[2] ..... B65D 23/00

[52] U.S. Cl. ..... 215/1 C; 220/70; D9/158

[58] Field of Search ..... D9/158, 159, 153, 165, D9/166, 169, 216, 217, 218; 220/70, 66; 215/1 C; 150/0.5

[56] References Cited

U.S. PATENT DOCUMENTS

| | | | |
|---|---|---|---|
| D. 28,483 | 4/1893 | Modes | D9/253 X |
| D. 248,927 | 8/1978 | Cassia | D9/158 |
| 3,045,887 | 7/1962 | Caine | 215/1 C X |
| 3,430,805 | 3/1969 | Buchner et al. | 220/66 |
| 3,434,626 | 3/1969 | Kinslow, Jr. | 220/66 |
| 3,957,168 | 5/1976 | Shine et al. | 215/1 C |

FOREIGN PATENT DOCUMENTS

| | | | |
|---|---|---|---|
| 888401 | 1/1962 | United Kingdom | 220/66 |

*Primary Examiner*—Allan N. Shoap

*Attorney, Agent, or Firm*—Donald L. Johnson; John F. Sieberth; Edgar E. Spielman, Jr.

[57] ABSTRACT

A thermoplastic container suitable for packaging frozen products is disclosed. The container has a hollow body having a hollow neck at its upper end, and a bottom wall at its lower end. The bottom wall, in one embodiment, has an oval center portion and a circular, upwardly and inwardly extending, connecting wall which is connected at its circumference to the lower end of the hollow body and is connected at its innermost extent to the oval center portion. In another embodiment the hollow body has an oval bottom wall which has a circular center portion. Connected to the circular center portion and the lower end of the hollow body is an oval, upwardly and inwardly extending, connecting wall which is connect at its circumference to the hollow body and at its innermost extent to the circular portion.

6 Claims, 12 Drawing Figures

CONTAINER

BACKGROUND OF THE INVENTION

It has been found impractical to utilize free-standing thermoplastic containers having conventionally designed, push-up bottoms for packaging products which will be frozen in the container. The conventional push-up bottom has a circular center portion which is connected to the bottom of the container body by a circular connecting wall. The angle of intersection between the circular portion and the circular connecting wall is constant throughout the circumference of the intersection. When this conventional design is utilized, the expansion of the product, when it freezes, pushes the bottom wall out thereby deforming the container so that it cannot be stood on its bottom. To overcome this difficulty it has been suggested that the bottom of the container be made with a greater wall thickness or that the container be provided with additional structure to reinforce the bottom wall. These solutions are not desirable as they require special programming of the parison or require intricate mold designs.

Therefore it is an object of this invention to provide a container having a bottom wall configuration which is capable of withstanding freezing expansion of the container product without deformation. It is a further object of this invention to provide such a container without requiring added thicknesses in the bottom wall or requiring additional complex wall structure.

THE INVENTION

This invention relates to a thermoplastic container having a hollow body; a hollow neck on one end of the body for dispensing the contents of the container; and a circular bottom wall closing off the other end of the body. The bottom wall has (i) an oval center portion, and (ii) a circular, upwardly and inwardly extending connecting wall which is connected, at its circumference, to the hollow body at its bottom and at its innermost extent to the oval center portion.

The invention also encompasses thermoplastic containers similar to the one above-described except that the bottom wall is oval and has a circular center portion. This center portion is connected to the bottom of the hollow body by an oval, upwardly and inwardly extending connecting wall, which wall is connected, at its circumference, to the hollow body and at its innermost extent to the circular portion.

It has been found, as is hereinafter shown, that the above two described containers are capable of having their product frozen without deformation of the bottom wall and without increasing the thickness of the container walls and without requiring complex bottom wall structure.

These and other features of this invention contributing satisfaction in use and economy in manufacture will be more fully understood when taken in connection with the accompanying drawings in which.

Figure 1:
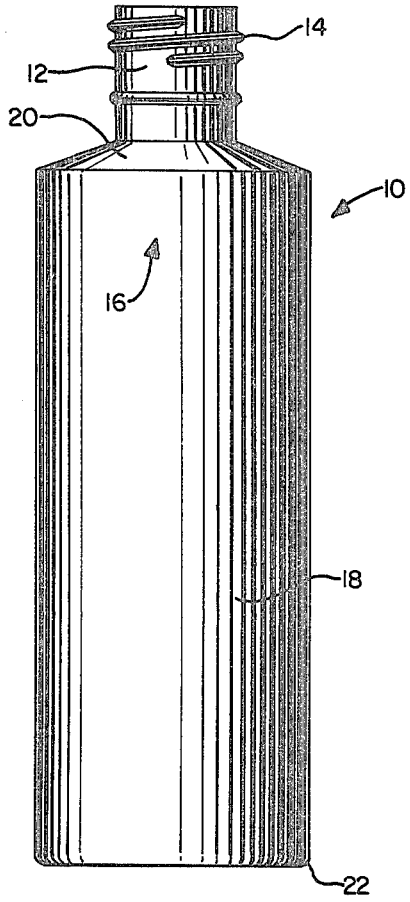
FIG. 1 is a side elevational view of an embodiment of this invention.

Referring now to FIGS. 1-6, there is shown a container, generally designated by the numeral 10, having a hollow body, generally designated by the numeral 16, and a bottom wall, generally designated by the numeral 24, which closes off the bottom of hollow body 16. At the upper end of hollow body 16 there is provided a top wall 20 which is upwardly and inwardly directed culminating in attachment to neck 12. Neck 12 has helical threads 14 about its exterior for cooperation with helical threads on a container cap which is not shown. It is to be understood that top wall 20 need not be upwardly and inwardly directed but may be horizontal or any other suitable configuration which the producer of the container of this invention may desire.

Hollow body 16 has a cylindrical sidewall 18 which at its lowermost end has a rounded inturned bottom portion 22. Hollow body 16 may be of any desired shape, the only requirement being that the bottom of hollow body 16 have a shape permitting a circular bottom wall to be attached thereto. For example, for hollow body 16, inturned bottom portion 22 has a circular configuration, as is shown in FIG. 2, so that connection of circular bottom wall 24 at its circumference to body 16 is effected.

Circular bottom wall 24 has an oval center portion 26 and a circular upwardly and inwardly extending connecting wall 28. Oval center portion 26 may be slightly concave, this being a preferred design. However, it is to be understood that oval center portion 26 may be planar. To insure that container 10 can be easily removed from the mold in which it is blown, the concavity of oval center portion 26 should not be excessive. It is well within those skilled in the art to determine the maximum concavity which bottom wall 26 can tolerate, such tolerance being dependent upon the diameter of the container, the method utilized for blow molding the container and the total configuration of the blow molds.

Figure 2:
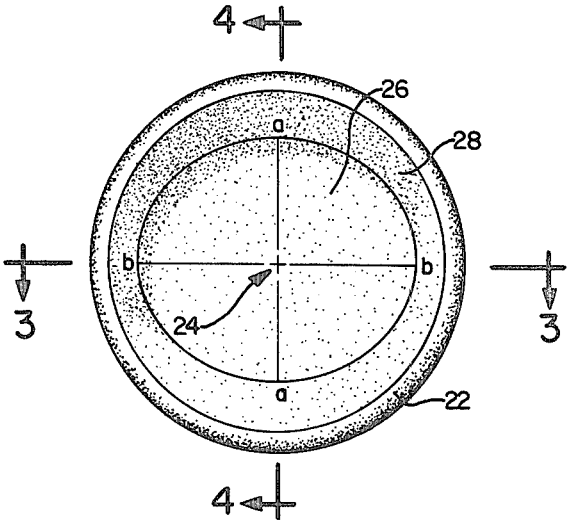
FIG. 2 is a bottom plan view of the embodiment shown in FIG. 1.
Figure 3:
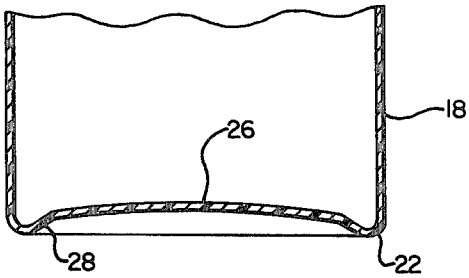
FIG. 3 is a partial sectional view taken along section lines 3—3 in FIG. 2.

As shown in FIG. 2, connecting wall 28 is connected at its outer circumference to rounded, inturned bottom portion 22 and at its innermost extent to oval center portion 26. By having this circle-oval relationship, the width of connecting wall 28 varies from a maximum at the minor axis a—a of oval portion 26, to a minimum at major axis b—b.

Figure 5:
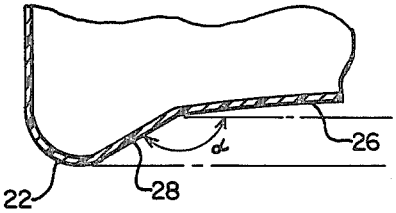
FIG. 5 is an enlarged partial view of the sectional view shown in FIG. 3.
Figure 4:
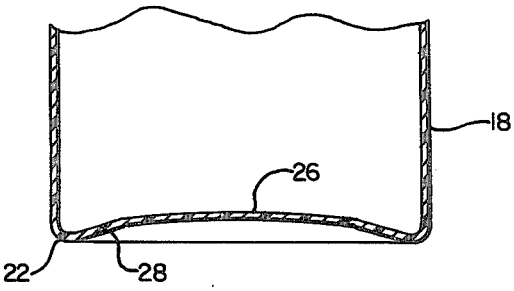
FIG. 4 is a partial sectional view taken along section lines 4—4 in FIG. 2.
Figure 6:
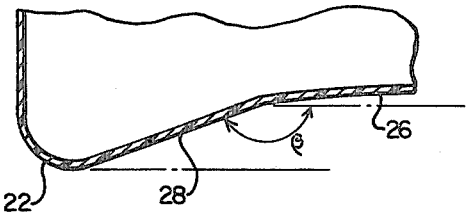
FIG. 6 is an enlarged partial view of the sectional view shown in FIG. 4.
Figure 7:
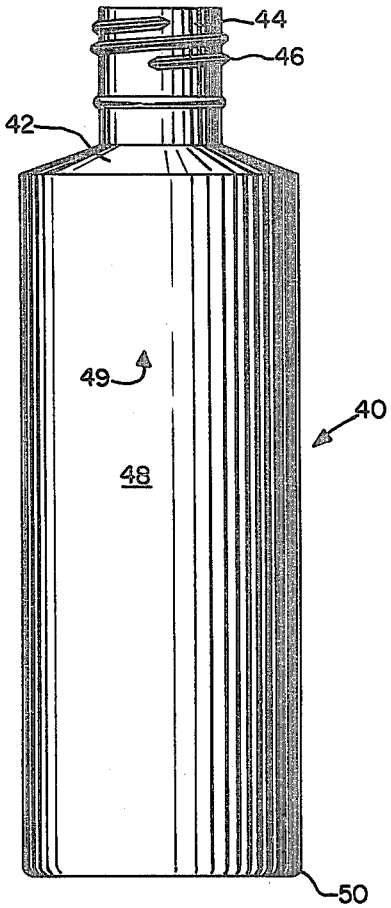
FIG. 7 is a front elevational view of another embodiment of this invention.

FIGS. 5 and 6 depict the difference in the angle of intersection between connecting wall 28 and oval center portion 26 at the major and minor axes, respectively. The angle of intersection, for the purpose of this invention, is defined as the angle formed between connecting wall 28 and an imaginary horizontal line drawn through the point of intersection between oval center portion 26 and connecting wall 28. The angle of intersection at the major axis a—a is angle $\alpha$ while the angle of intersection at the minor axis b—b is angle $\beta$. As can be appreciated from the drawings, the angle of intersection between the connecting wall and the oval center portion varies as it moves from minor axis a—a to major axis b—b. It has been found that, preferably, angle $\alpha$ should exceed angle $\beta$ by about 10°. It has also been found desirable to have angle $\alpha$ within the range of from about 145° to about 158°. Angle $\beta$ is preferably selected from the range of from about 160° to about 168°.

Figure 8:
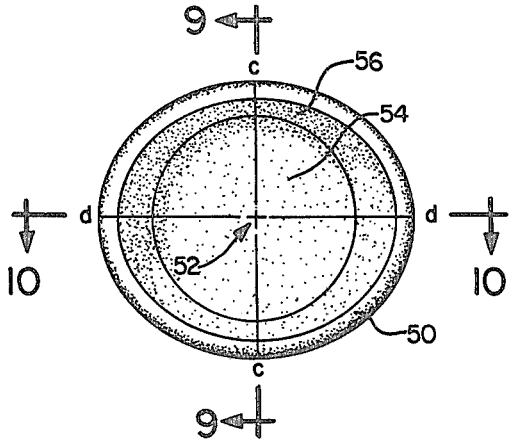
FIG. 8 is a bottom plan view of the embodiment shown in FIG. 7.
Figure 9:
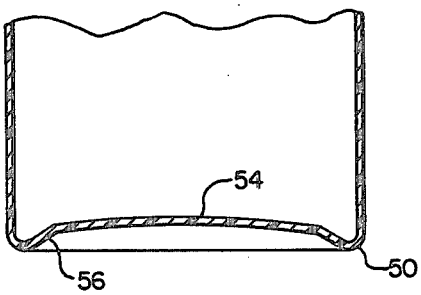
FIG. 9 is a partial sectional view taken through section lines 9—9 of FIG. 8.

Another container of this invention is depicted in FIGS. 7–10 and is generally designated by the numeral 40. Container 40 has a body portion, generally designated by the numeral 49, which has at its upper end neck 44 and is closed off at its bottom end by a bottom wall, generally designated by the numeral 52. Body portion 49 has a rounded, inturned wall 50 at its lowermost end and has a sidewall 48 which is oval in cross-section, as can be seen in FIG. 8. Connecting neck 44 to sidewall 48 is an inwardly and upwardly directed top wall 42. About neck 44 are helical threads 46 which are adapted to achieve attachment with complementary helical threads on a cap which is not shown. As was the case for the top wall in the embodiment shown in FIGS. 1–6, top wall 42 may be of varying design. Also sidewall 48 may vary in shape, the only requirement being that at its lower-most end sidewall 48 have an oval shape in cross-section for attachment to oval bottom wall 52. This oval shape is illustrated by rounded, inturned bottom portion 50, as seen in FIG. 8.

Figure 11:
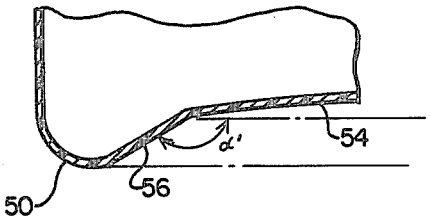
FIG. 11 is an enlarged partial view of the sectional view shown in FIG. 9.
Figure 10:
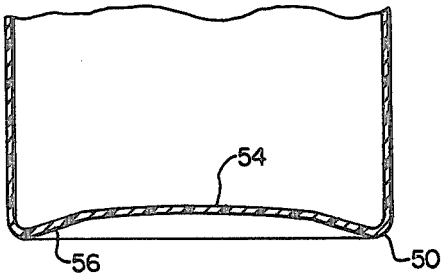
FIG. 10 is a partial sectional view taken through section lines 10—10 of FIG. 8.
Figure 12:
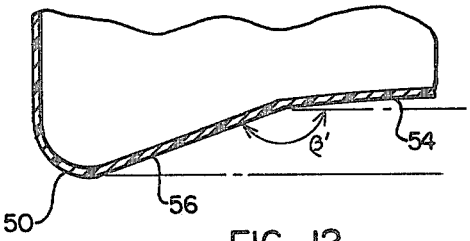
FIG. 12 is an enlarged partial view of the sectional view shown in FIG. 10.

Bottom wall 52 has a circular center portion which is connected to rounded inturned bottom portion 50 by means of oval connecting wall 56. Oval connecting wall 56 is attached at its outer circumference to rounded, inturned bottom portion 50 and at its innermost extent to circular center portion 54. The angle of intersection between circular portion 54 and connecting wall 56 at minor axis c—c—for oval bottom wall 52—is designated as angle $\alpha'$ as seen in FIG. 11. The angle of intersection measured at major axis d—d is designated as $\beta'$ and is shown in FIG. 12. It is preferred that angle $\beta'$ be at least 10° larger than angle $\alpha'$. The angles of intersection will vary from minor axis c—c to major axis d—d. Preferably, angle $\alpha'$ is selected from the range of from about 160° to about 168°, while angle $\beta'$ is selected from the range of from about 145° to about 158°.

It is theorized, but this invention is not limited to this theory, that the variance in the angle of intersection for the two described embodiments provides the resistance to deformation and inversion of the bottom wall when pressure is exerted by the freezing of the container contents. In conventional containers the angle of intersection is constant through the total circumference of the bottom wall and deformation occurs.

To illustrate this resistance to deformation or inversion, six polyethylene containers having the configuration shown in FIGS. 1–4 and six polyethylene containers having an identical configuration except that the center wall portion and the connecting wall was circular were tested. Both sets of containers had (1) sidewalls that averaged 0.0032 inch thick, (2) inturned, rounded bottom portions which averaged 0.012 inch thick and (3) a bottom wall averaging 0.0030 inch thick. Both sets of containers were blown on conventional blow molding machinery.

The two sets of bottles were filled with water to their fill line and were capped. The containers were then placed in a freezer maintained at an average temperature of 15° F. After a 24-hour period had elapsed the containers were examined and it was found that all containers with conventional bottoms showed distortion and inversion of the bottom wall. The other set of containers which were made in accordance with this invention were examined and were found to have no distortion whatever. All bottles were returned to the freezer and were examined again after a three-week period had elapsed. The distortion for the conventional container remained while the containers of this invention were found to still be distortion-free. It was concluded that containers having a bottom wall with a varying angle of intersection are more resistant to deformation than conventional containers with bottoms having a constant angle of intersection.

The containers of this invention can be of any suitable thermoplastic; for example, polyethylene, polypropylene, polyvinyl chloride or polyethylene terephthalate. The wall thicknesses may be any suitable conventional thickness, there being no need for having wall thicknesses larger than normal. The bottles can also be produced by conventional blow molding techniques such as the technique described in U.S. Pat. No. 3,860,375.

What is claimed is:

1. A thermoplastic container comprising:

a. a hollow body;

b. a hollow neck on one end of said body for dispensing the contents of said container; and c. a circular bottom wall closing off the other end of said body, said bottom wall comprising, i. an oval center portion, and ii. a circular, upwardly and inwardly extending connecting wall which is connected at its circumference to said other end of said hollow body and at its innermost extent to said oval center portion.

2. The container of claim 1 wherein the angle of intersection between said connecting wall and said oval center portion at its major axis is within the range of from about 145° to about 158° and the angle of intersection between said connecting wall and said oval center portion at its minor axis is within the range of from about 160° to about 168°, said former angle of intersection being less than said latter angle of intersection by at least 10°.

3. The container of claim 1 wherein said hollow body has a rounded inturned bottom portion which connects to said connecting wall to form said connection between said connecting wall and said other end of said hollow body.

4. The container of claim 1 wherein said hollow body is cylindrical.

5. The container of claim 1 wherein said container is made of polyethylene.

6. The container of claim 1 wherein the angle of intersection between said connecting wall and said oval center portion at its major axis is within the range of from about 145° to about 158° and the angle of intersection between said connecting wall and said oval center portion at its minor axis is within the range of from about 160° to about 168°, said former angle of intersection being less than said latter angle of intersection by at least 10°, wherein said hollow body has a rounded inturned bottom portion which connects to said connecting wall to form said connection between said connecting wall and said other end of said hollow body and wherein said hollow body is cylindrical and made of polyethylene.

* * * * *

UNITED STATES PATENT AND TRADEMARK OFFICE

CERTIFICATE OF CORRECTION

PATENT NO. : 4,197,954

DATED : April 15, 1980

INVENTOR(S) : Eugene W. Oltman and Robert N. Hills

It is certified that error appears in the above—identified patent and that said Letters Patent is hereby corrected as shown below:

Column 3, line 1, reads "major axis a-a is angle α", should read -- major axis b-b is angle α --; line 2, reads "minor axis b-b is angle β.", should read -- minor axis a-a is angle β. --; line 6, reads "preferably, angle α should exceed", should read -- preferably, angle β should exceed --; line 7, reads "angle β by about 10°.", should read -- angle α by about 10°. --; line 43, reads "Preferably, angle α' is", should read -- Preferably, angle β' is --; and line 44, reads "while angle β'", should read -- while angle α' --.

Signed and Sealed this

*Sixteenth* Day of *February 1982*

[SEAL]

*Attest:*

GERALD J. MOSSINGHOFF

*Attesting Officer*

*Commissioner of Patents and Trademarks*